US011426003B2

(12) United States Patent
Hancock

(10) Patent No.: US 11,426,003 B2
(45) Date of Patent: Aug. 30, 2022

(54) CHAIR SUPPORT AND BOOSTER SEAT

(71) Applicant: Douglas Hancock, Fargo, ND (US)

(72) Inventor: Douglas Hancock, Fargo, ND (US)

( * ) Notice: Subject to any disclaimer, the term of this patent is extended or adjusted under 35 U.S.C. 154(b) by 0 days.

(21) Appl. No.: 17/114,866

(22) Filed: Dec. 8, 2020

(65) Prior Publication Data

US 2022/0007840 A1 Jan. 13, 2022

Related U.S. Application Data

(60) Provisional application No. 63/049,679, filed on Jul. 9, 2020.

(51) Int. Cl.

| | |
|---|---|
| ***A61G 5/08*** | (2006.01) |
| ***A61G 5/10*** | (2006.01) |
| ***A47C 7/02*** | (2006.01) |
| ***A47C 7/42*** | (2006.01) |

(52) U.S. Cl.

CPC ..... *A47C 7/0213* (2018.08); *A47C 7/425* (2013.01); *A61G 5/1091* (2016.11)

(58) Field of Classification Search

CPC ..... A47C 7/0213; A47C 7/425; A61G 5/1091
USPC ..... 297/464, 466, 467, 485
See application file for complete search history.

(56) References Cited

U.S. PATENT DOCUMENTS 2,694,437 A * 11/1954 Glaser ..... A61G 5/006 297/464 X
2,769,483 A * 11/1956 Peterson ..... A61G 5/00 297/464 X
3,536,357 A * 10/1970 Murcott ..... A61F 5/3784 297/485
3,640,571 A * 2/1972 Keropian ..... A61G 5/12 297/464
3,713,692 A * 1/1973 McCracken ..... A47D 15/006 297/485 X
4,190,287 A * 2/1980 Lemisch ..... A61G 5/10 297/466
4,647,066 A * 3/1987 Walton ..... A47C 7/405 297/464 X
4,732,423 A * 3/1988 Condon ..... A61G 5/00 297/284.1
4,813,693 A 3/1989 Lockard et al.
4,981,325 A * 1/1991 Zacharkow ..... A47C 7/405 297/230.14
5,056,869 A * 10/1991 Morrison ..... A47D 15/006 297/485
5,176,706 A * 1/1993 Lee ..... A61G 5/00 297/353
5,366,277 A * 11/1994 Tremblay ..... A47D 15/006 297/464 X
5,427,438 A * 6/1995 Fochs ..... A61H 3/04 297/467 X
5,443,304 A * 8/1995 Fochs ..... A61H 3/04 297/467 X (Continued)

*Primary Examiner* — Rodney B White
(74) *Attorney, Agent, or Firm* — Boudwin Intellectual Property; Daniel Boudwin

(57) ABSTRACT

A chair support and booster seat is shown and described. The chair support and booster seat is comprised of a frame. The frame is comprised of a lower frame section rotatably coupled to an upper frame section. The upper frame section is comprised of a pair of vertical supports. A securement arm is rotatably coupled to each one of the pair of vertical supports. A chair seat is secured to the lower frame section.

12 Claims, 7 Drawing Sheets

(56) References Cited

U.S. PATENT DOCUMENTS 5,447,356 A * 9/1995 Snijders ..... A47C 7/405 297/464 X
5,496,092 A * 3/1996 Williams ..... A61F 5/3792 297/464 X
5,551,756 A * 9/1996 Gurasich ..... A61G 5/00 297/338
5,556,120 A * 9/1996 Davis ..... A61G 5/00 280/250.1
5,564,788 A * 10/1996 Warhaftig ..... A61F 5/3776 297/464 X
5,720,520 A 2/1998 Bengtson et al.
5,816,662 A * 10/1998 Rumburg ..... A47D 15/006 297/485 X
5,950,263 A 9/1999 Hanson et al.
5,996,716 A 12/1999 Montiglio et al.
6,032,975 A 3/2000 Hanson et al.
6,154,899 A * 12/2000 Brooke ..... A61G 5/006 297/DIG. 4
6,247,756 B1 * 6/2001 Wagner ..... A61G 5/10 297/485 X
6,378,947 B1 * 4/2002 Barber ..... A61G 5/1043 297/466 X
6,460,927 B1 * 10/2002 Groth ..... A61G 5/12 297/284.9
6,840,577 B2 * 1/2005 Watkins ..... A61G 5/1064 297/464 X
7,472,956 B2 * 1/2009 Makhsous ..... A61G 5/1043 297/464 X
7,832,807 B2 * 11/2010 Shickle ..... A61G 5/10 297/466
8,152,236 B1 * 4/2012 Romero ..... A47D 15/006 297/485 X
2006/0017263 A1 * 1/2006 Chen ..... A61G 5/0891 280/647
2006/0091706 A1 * 5/2006 Christofferson ..... A61G 5/1091 297/130
2006/0097562 A1 * 5/2006 Hiruta ..... A61G 5/10 297/467
2012/0200133 A1 * 8/2012 Simpson ..... A61G 5/10 297/397
2017/0252239 A1 * 9/2017 Nadeau ..... A61G 5/122

* cited by examiner

CHAIR SUPPORT AND BOOSTER SEAT

CROSS REFERENCE TO RELATED APPLICATIONS

This application claims the benefit of U.S. Provisional Application No. 63/049,679 filed on Jul. 9, 2020. The above identified patent application is herein incorporated by reference in its entirety to provide continuity of disclosure.

BACKGROUND OF THE INVENTION

The present invention relates to chair supports and booster seats. More particularly, the present invention provides an attachment for a chair that will allow for boosting and supporting of a paraplegic individual when sitting.

There are currently several devices designed for individuals who do not have control or full control of their body. One of these devices is a wheelchair. There are several different styles of wheelchair designed to help accommodate individuals. However, these wheelchairs have drawbacks. In current models of wheelchairs, individuals may lean side to side or slide from the chair. Even when the chair includes a seat belt of shoulder straps this issue is still not entirely fixed.

One specifically designed wheelchair is meant to help an individual enter a pool or other water source. These wheelchairs have several drawbacks especially for children. Current aquatic wheelchairs have a straight backrest. This causes children to slip from the chair entering the water in an unsafe manner. Further, standard aquatic wheelchairs have a seat that is only nineteen inches from the floor of the water. At this height most children will be dunked under the water when entering a pool.

Current booster seats do not solve this problem and often cause issues of their own. In some instances, booster seats are not secured properly to the chair causing the user to fall from the chair. In other instances, the booster floats in water. This means as the chair enters the water, the booster rises from the chair and begins to float causing an unstable seating area.

Consequently, there is a need for an improvement in the art of chair supports. The present invention substantially diverges in design elements from the known art while at the same time solves a problem many people face when entering a swimming pool or even just sitting in a regular chair. In this regard the present invention substantially fulfills these needs.

SUMMARY OF THE INVENTION

The present invention provides a chair support and booster seat wherein the same can be utilized for providing convenience for the user when using a wheelchair to enter a pool. The chair support and booster seat is comprised of a frame. The frame is comprised of a lower frame section rotatably coupled to an upper frame section. The upper frame section is comprised of a pair of vertical supports. A securement arm is rotatably coupled to each one of the pair of vertical supports. A chair seat is secured to the frame.

Another object of the chair support and booster seat is to include a chair seat which is removably secured to the frame.

Another object of the chair support and booster seat is to include a seatbelt secured to the frame.

Another object of the chair support and booster seat is to include a plurality of securement straps connected to the frame, wherein the securement straps will secure the frame to a chair.

Another object of the chair support and booster seat is to include securement arms which are comprised of a first arm bar rotatably coupled to the vertical support and a second arm bar rotatably coupled to the first arm bar.

Another object of the chair support and booster seat is to include securement arms where the second arm bar is coupled to the first arm bar perpendicularly.

Another object of the chair support and booster seat is to include a lower frame section is comprised of at least a pair of horizontal supports.

Another object of the chair support and booster seat is to include a lower frame section which is further comprised of a plurality of arm connectors, wherein the arm connectors will engage the arm of an existing chair when the chair support and booster seat is attached.

Another object of the chair support and booster seat is to include rotational couplings which are held in position via friction.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
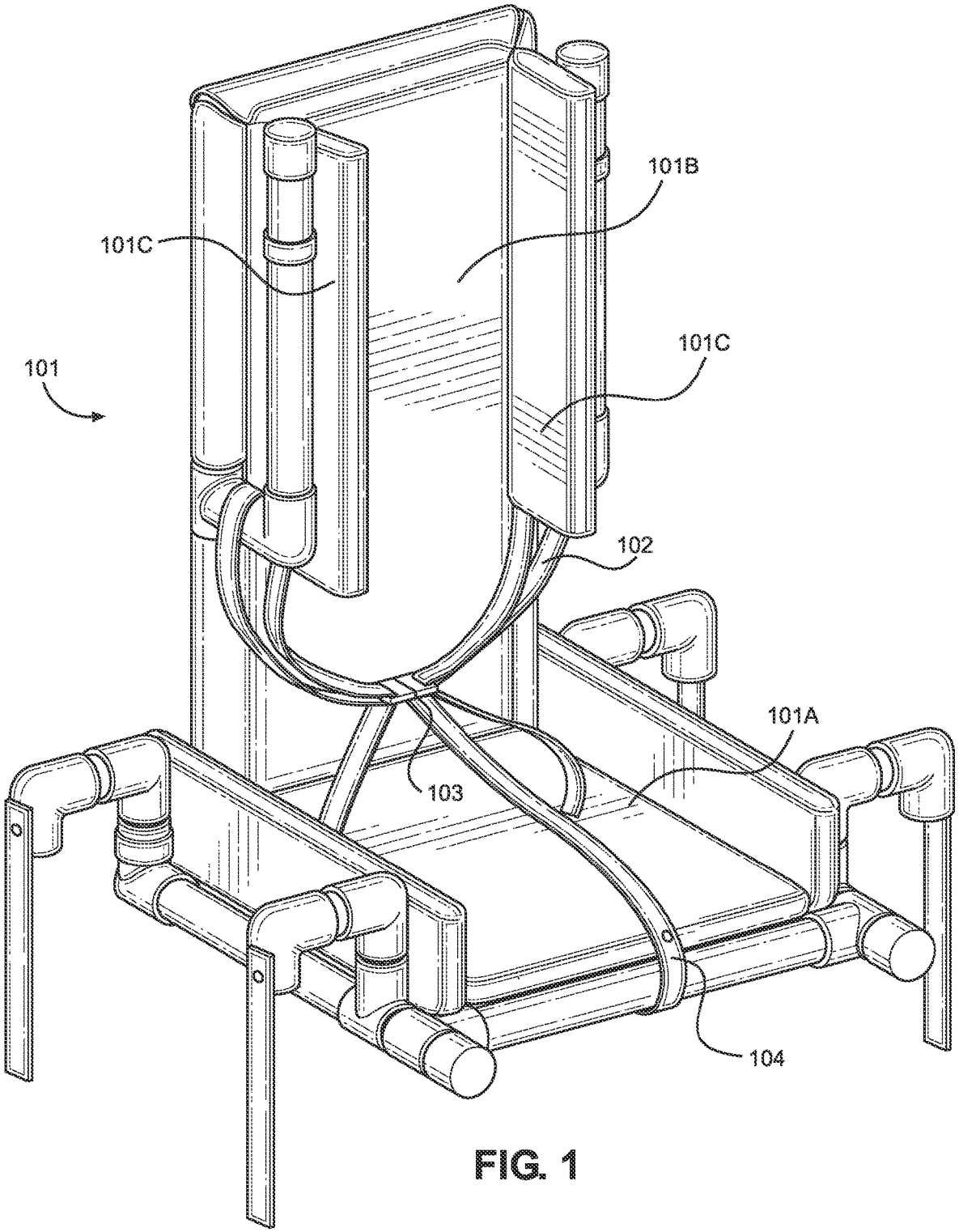
FIG. 1 shows a perspective view of an embodiment the chair support and booster seat.

With regard to the reference numerals used, the following numbering is used throughout the drawings.

101 Chair Pad
101A Seat section
101B Back section
101C Side pads
102 Seatbelt
103 Connector
104 Adjuster
200 Frame
201 Upper frame section
202 Lower frame section
203 Vertical supports
204 Cross bar
205 Elbow connector
206 First arm bar
207 Second arm bar
208 Horizontal supports

209 Horizontal cross bar
210 Arm supports
301 Center line
501 Wheelchair
503 Wheels
504 Arm rests
505 Chair seat
506 Chair back
507 Front
601A Seat pad strap
601B Arm bar strap
602A Arm back connection strap
602B Chair arm connection strap

DETAILED DESCRIPTION OF THE INVENTION

Reference is made herein to the attached drawings. Like reference numerals are used throughout the drawings to depict like or similar elements of the chair support and booster seat. For the purposes of presenting a brief and clear description of the present invention, a preferred embodiment will be discussed as used for the chair support and booster seat. The figures are intended for representative purposes only and should not be considered to be limiting in any respect.

Referring now to FIG. 1, there is shown a perspective view of an embodiment the chair support and booster seat. The chair support and booster seat is comprised of a chair pad 101 secured to a frame. The frame will be fully discussed in the description of FIG. 2. The chair pad 101 is a flexible material. In one embodiment, there is an external material and an internal material. In this embodiment, the internal material is a padding material. In one embodiment, the chair pad 101 is waterproof.

The chair pad 101 has a seat section 101A. The seat section 101A is secured to a back section 101B. In one embodiment, the back section 101B is secured to the seat section 101A via a hinge like connection. In this embodiment, the connection point between the seat section 101A and the back section 101B has a thinner connection then that of the rest of the sections.

The back section 101B is secured to a pair of side pads 101C. In one embodiment, the side pads 101C extend the length of the back section 101B. In another embodiment, the side pads 101C are shorter in length than the back section 101B. In one embodiment, the side pads 101C are secured to the back section 101B via hinge like connections. In this embodiment, the connection point has a thinner connection then that of the rest of the sections. In another embodiment, the side pads 101C are connected such that they are integral with the back section 101B.

In one embodiment, the chair support and booster seat includes a seatbelt 102. The seatbelt 102 is secured to the frame at each end of the seatbelt 102. The seatbelt 102 includes a connector 103 along the seatbelt 102 in order to allow the seatbelt 102 to be removably secured together. In one embodiment, the seatbelt 102 has an adjustable length. In a further embodiment, there is an adjuster 104 located along at least one section of the seatbelt 102.

In one embodiment, there is a groin belt 104. The groin belt 104 will prevent an individual from sliding forward in the seat and sliding from the seat. The groin belt 104 is secured to the frame at one end of the groin belt 104. The groin belt is substantially perpendicular to the seatbelt 102. In one embodiment, the connector 103 of the seatbelt 102 has a further connection point. This will allow the groin belt 104 to be removably secured to the connector 103. In one embodiment, the groin belt 104 has an adjustable length. In one embodiment there is an adjuster 105 located along the groin belt 104.

Figure 2:
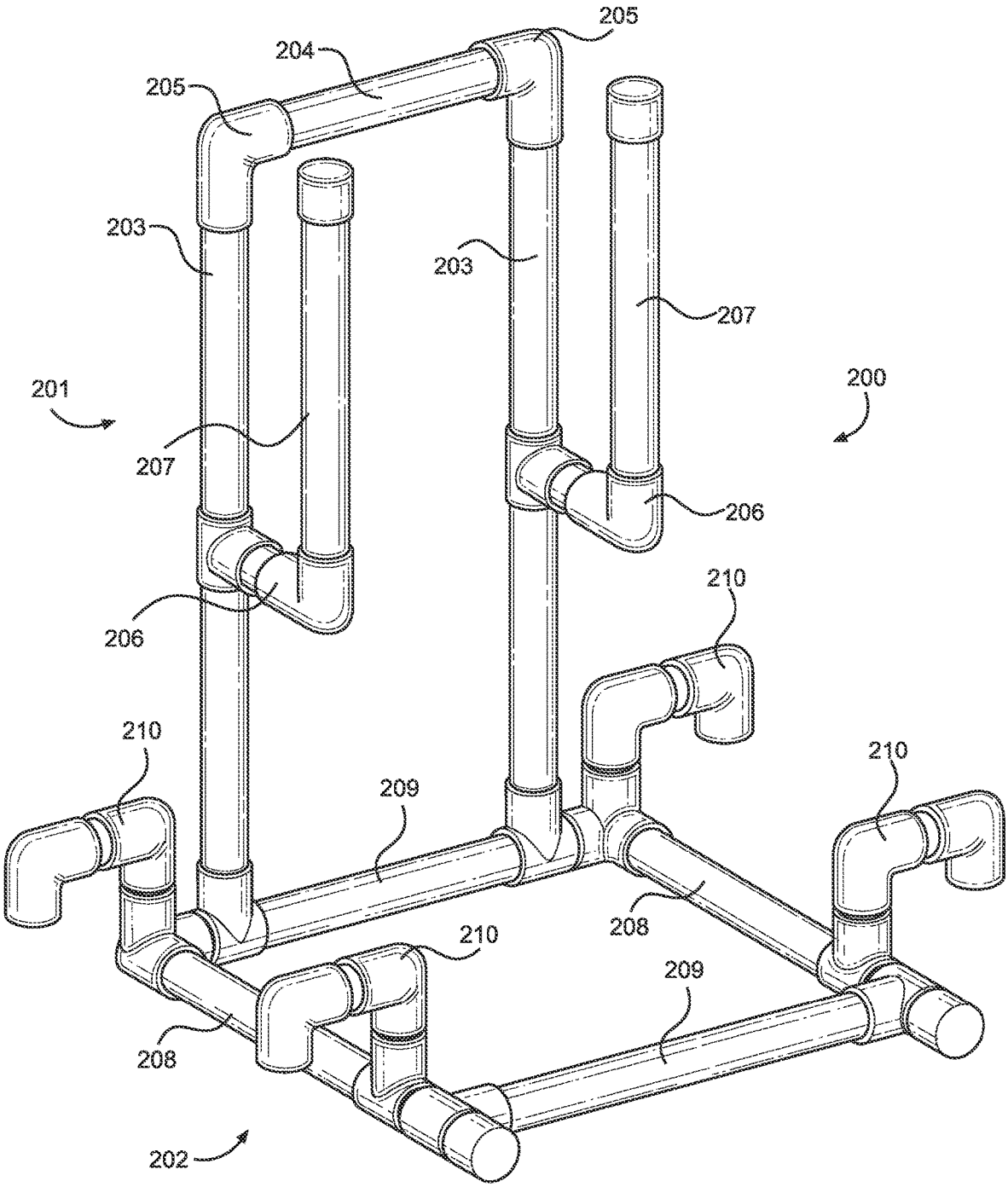
FIG. 2 shows a perspective view of an embodiment of the frame of the chair support and booster seat.

Referring now to FIG. 2, there is shown a perspective view of an embodiment of the frame of the chair support and booster seat. The frame 200 of the chair support and booster seat has an upper frame section 201 and a lower frame section 202. The upper frame section 201 is hingedly secured to the lower frame section 202. This connection will be more thoroughly discussed below. In one embodiment, the frame 200 is made of a PVC piping material. This will allow the frame 200 to be lightweight and easy to clean and dry.

The upper frame section 201 is comprised of a pair of vertical supports 203. In one embodiment, the pair of vertical supports 203 are parallel to each other. The pair of vertical supports 203 are connected together at a top end by a cross bar 204. In one embodiment, the cross bar 204 is secured to each of the pair of vertical supports 203 with an elbow connector 205. In one embodiment, there are further cross bars along the pair of vertical supports 203.

Each of the pair of vertical supports 203 has an attached arm bar assembly that includes a first arm bar 206 rotatably secured along the length thereof. In one embodiment the first arm bar 206 is secured perpendicularly to the vertical support 203. In a further embodiment, the first arm bar 206 is configured to rotate forward from the frame toward the back section. This will push the side section forward as described in FIG. 3A and FIG. 3B. In one embodiment, the arm bar assembly further includes a second arm bar 207 secured to the first arm bar 206. In one embodiment, the second arm bar 207 is secured to the first arm bar 206 perpendicularly.

The lower frame section 202 is comprised of a pair of horizontal supports 208. The horizontal supports 208 are secured together with a pair of horizontal cross bars 209. In one embodiment, there is a horizontal cross bar 209 located at each end of the horizontal supports 208. In one embodiment, the lower frame section 202 is wider than the upper frame section 201. In one embodiment, the upper frame section 201 is hingedly coupled to a horizontal cross bar 209. This will allow the upper frame section 201 to be moved with respect to the lower frame section 202.

The lower frame section 202 is further comprised of a plurality of arm supports 210. The arm supports 210 are U shaped sections which are secured to the horizontal supports 208. The arm supports 210 will contact the arm of a chair as described in FIG. 5 and FIG. 6. In one embodiment, there are two arm supports 210 attached to each of the horizontal supports 208.

Figure 3A:
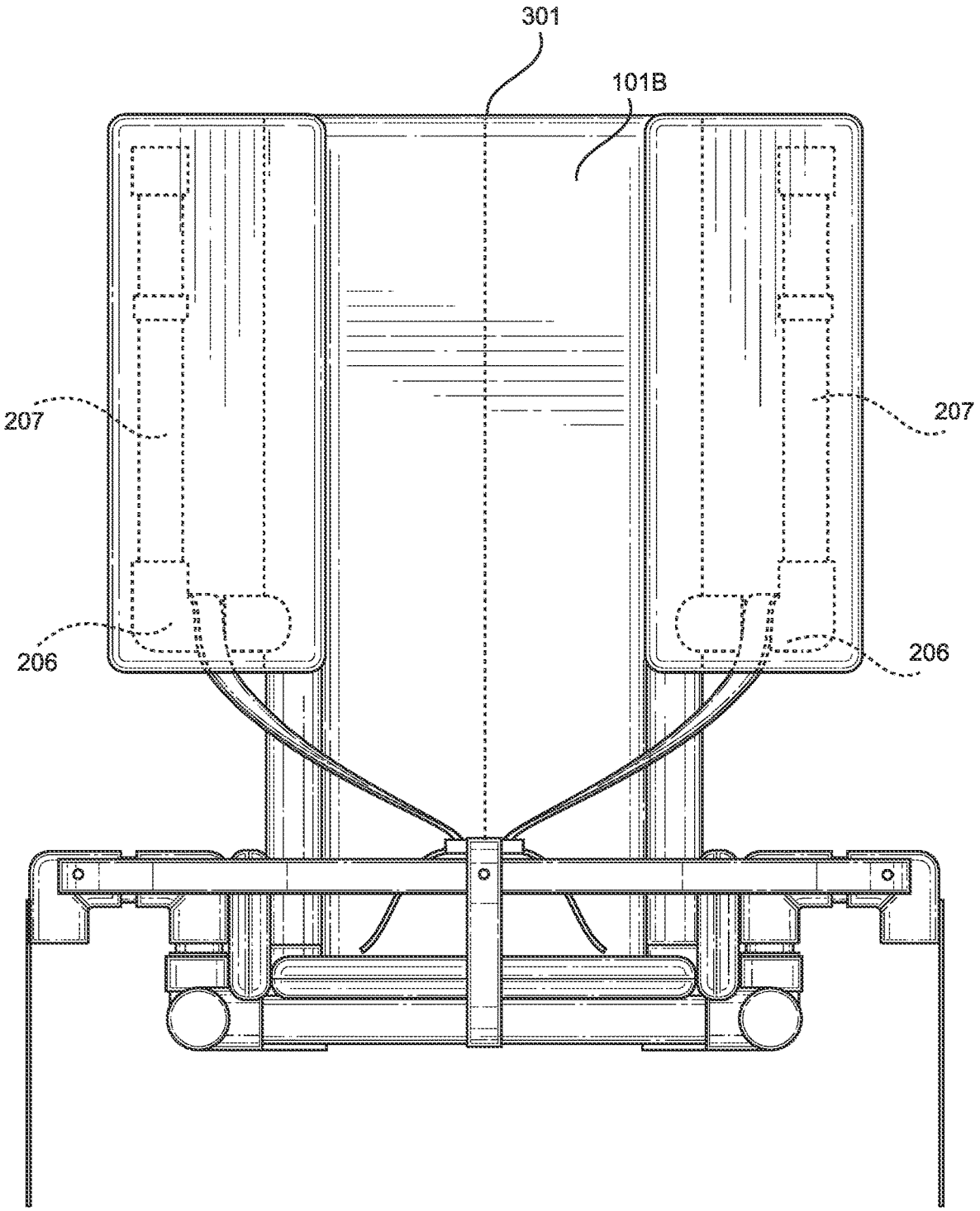
FIG. 3A shows a front view of an embodiment of the chair support and booster seat with an open back.
Figure 3B:
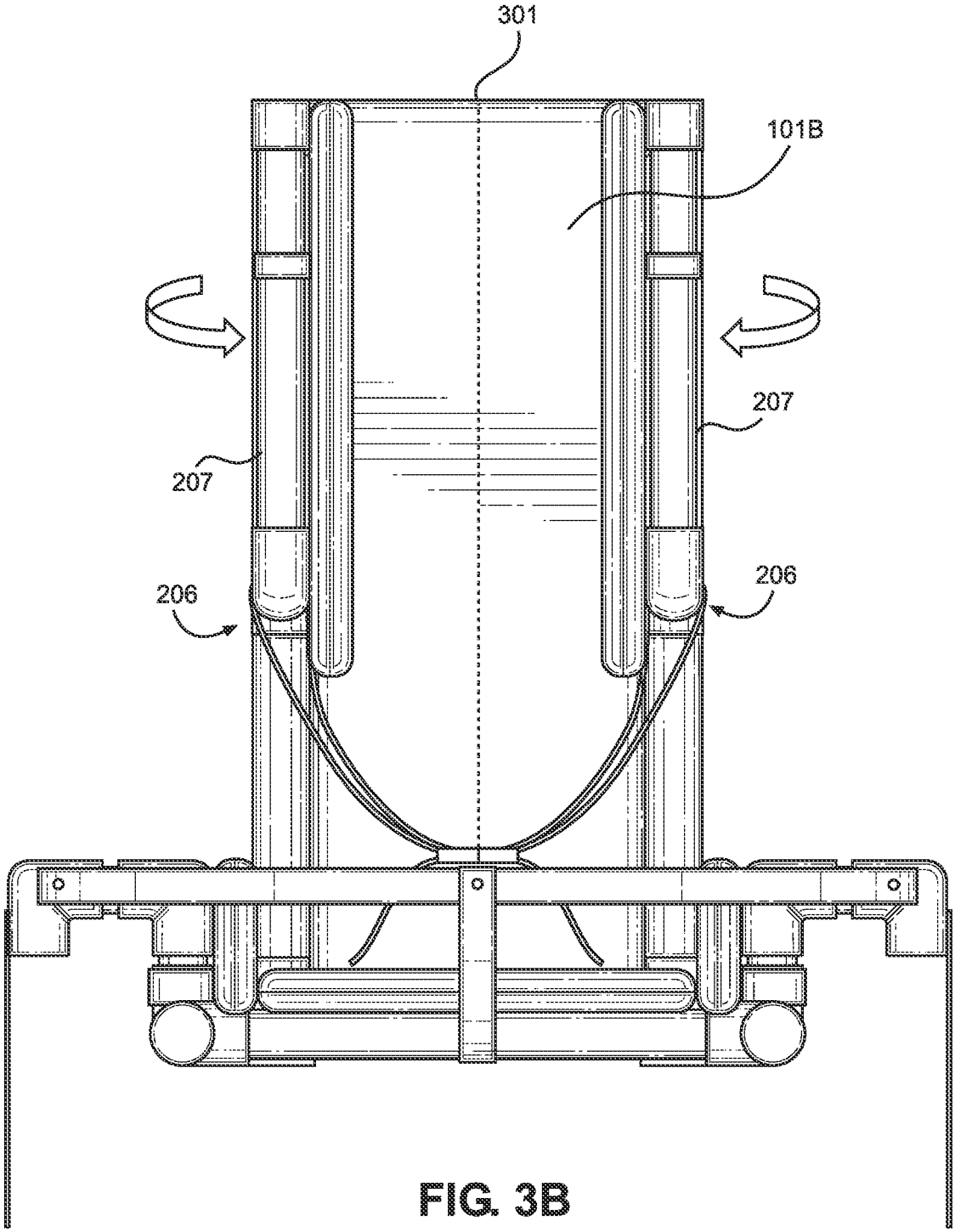
FIG. 3B shows a front view of an embodiment of the chair support and booster seat with a closed back.

Referring now to FIG. 3A and FIG. 3B, there is shown front views of an embodiment of the chair support and booster seat with an open back and a closed back. Instead of shoulder straps to secure an individual in the chair support and booster seat, the present design uses the arm bars 206, 207 to secure an individual. It is important to note that shoulder straps may be used in addition to the arm bars 206, 207. In FIG. 3A the arm bars 206, 207 are open such that each vertical support and each arm bar 206, 207 are all on the same plane. This will allow the chair support and booster seat to function as a normal chair. Further, this will allow an individual to enter the chair.

In FIG. 3B the arm bars 206, 207 are shown in a closed position. This happens with the first arm bars 206 are brought toward each other and rotated inwards toward a center line 301 of the back section 101B. This will secure an individual into the chair in a fully supporting manner. The support will occur due to the arm bars 206, 207 closing together to apply pressure to the body of the individual. In other embodiments, the second arm bars 207 are further rotated to allow for further securements and adjustments. The arm bars 206, 207 are not limited to a fully open or fully closed position. In one embodiment, the arm bars 206, 207 may be placed in any number of rotatable positions.

Figure 4:
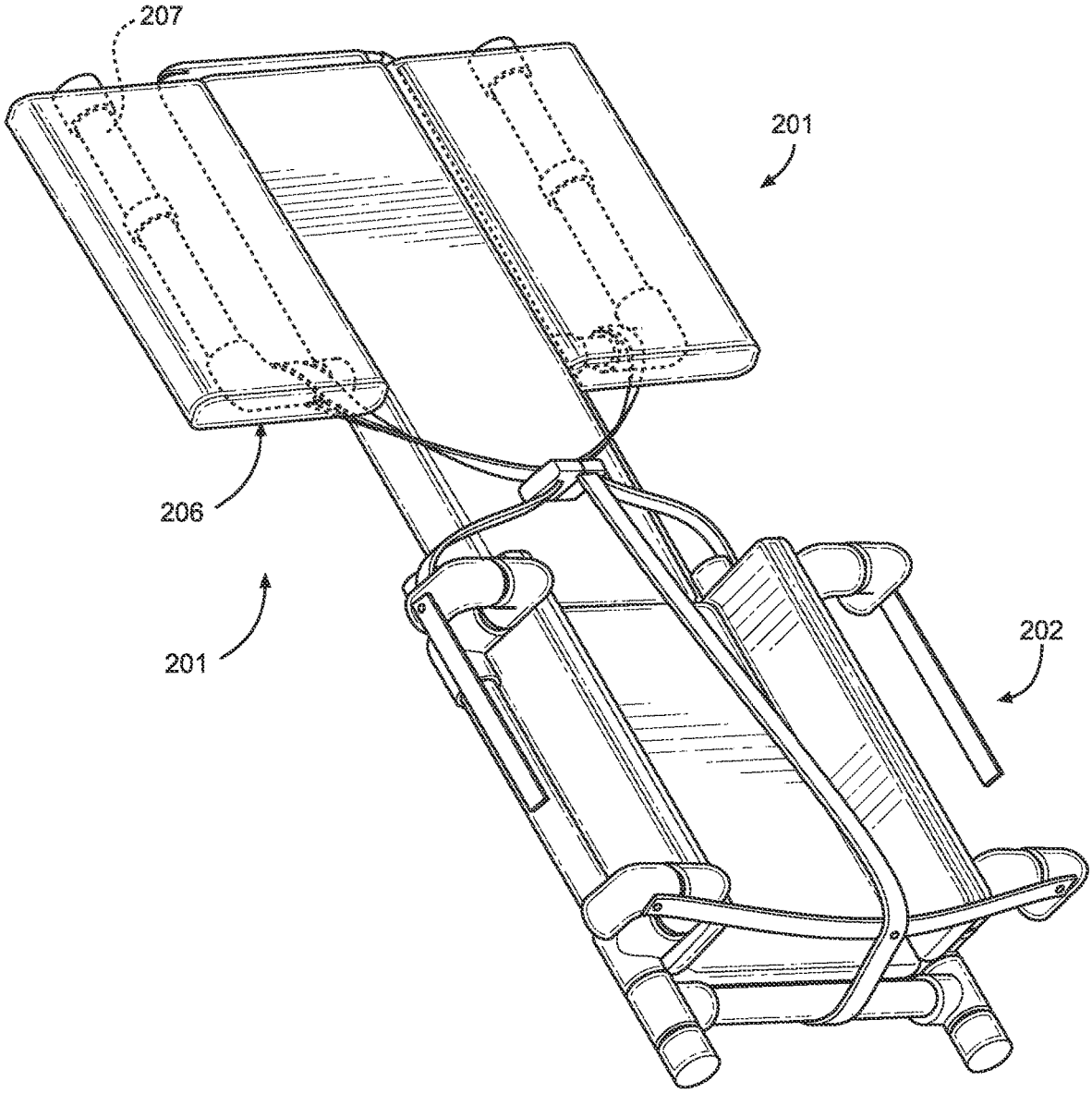
FIG. 4 shows a perspective view of an embodiment of the chair support and booster seat folded in a flat position for storage.

Referring now to FIG. 4, there is shown a perspective view of an embodiment of the chair support and booster seat folded in a flat position for storage. In one embodiment, the rotatable connection of the arm bars 206, 207 and the hinge connection of the upper frame section 201 and the lower frame section 202 allow for the chair support and booster seat to be folded flat. This will allow for easy storage. Further, in several embodiments the connections are secured together and in place via friction. This is demonstrated by the absence of any securement devices in the drawings.

Figure 5:
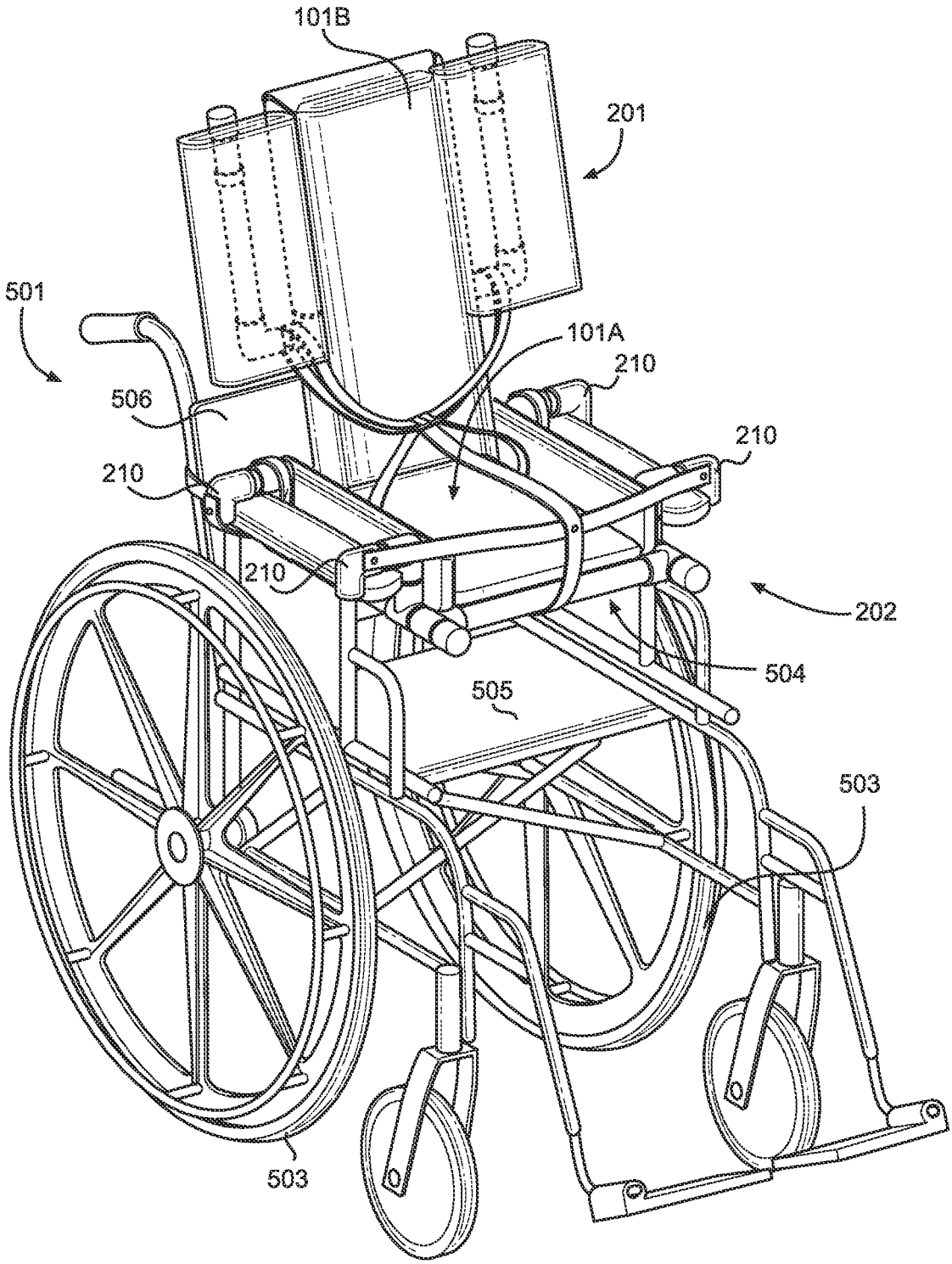
FIG. 5 shows a perspective view of an embodiment of the chair support and booster seat attached to a wheelchair.

Referring now to FIG. 5, there is shown a perspective view of an embodiment of the chair support and booster seat attached to a wheelchair. In the shown embodiment, the chair support and booster seat is shown in a wheelchair 501. The wheelchair 501 includes a frame and a plurality of wheels 503. The wheelchair 501 further has a pair of arm rests 504. The wheelchair 501 has a chair seat 505 and a chair back 506.

The chair support and booster seat is placed on the wheelchair 501 such that the lower frame section 202 is placed forward of the connection between the chair seat 505 and the chair back 506. This will allow for the upper frame section 201 to be tilted back, also tilting the back portion 101B. This will allow an individual to be tilted back in the chair support and booster seat. This will help avoid the individual sliding off of the chair.

In one embodiment, the arm connectors 210 are placed over each of the arm rests 504. In one embodiment, the arm connectors 210 which are attached to the front 507 of the lower frame section 202 hold the front of the lower frame section 202 in a position that is higher than that of the rear of the lower frame section 202 on a horizontal plane. This will further prevent an individual from sliding forward off of the seat section 101A.

Figure 6:
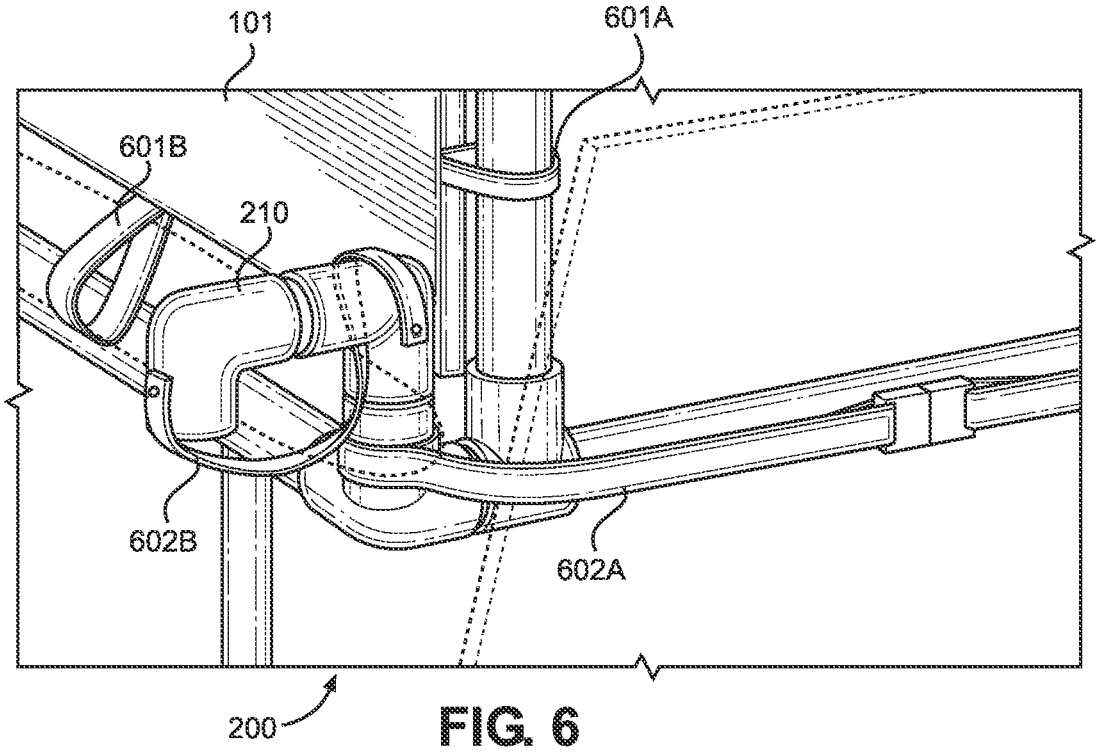
FIG. 6 shows a close-up view of an embodiment of the connection straps for the chair support and booster seat.

Referring now to FIG. 6, there is shown a close-up view of an embodiment of the connection straps for the chair support and booster seat. The chair support and booster seat has two sets of connection straps. The first set of connection straps are comprised of straps which hold the chair pad 101 to the frame 200. There can be seen a seat pad strap 601A and an arm bar strap 601B for each arm bar. In further embodiments, additional straps may be used. In yet a further embodiment, the chair pad 101 is secured to the frame with additional connectors.

The second set of connections straps holds the frame to a chair. The second set of connection straps include at least one chair back strap 602A. In one embodiment, the at least one chair back strap 602A is an adjustable strap. The at least one chair back connection strap 602A will wrap around the back of a chair pulling the chair support and booster seat into the chair. In one embodiment, each end of the chair back connection strap 602A is secured to the frame 200. In another embodiment, the chair back connection strap 602A is secured around the frame and connected around the back of a chair at the ends of the chair back connection strap 602A.

The second set of connection straps further includes a plurality of chair arm connection straps 602B. In one embodiment, there is a chair arm connected strap 602B for each chair arm connector 210. In one embodiment, the chair arm connection straps 602B are adjustable straps. In one embodiment, the chair arm connection straps 602B are secured to the frame at each end. This will ensure a secure fit to the desired chair.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chair support adaptor and booster seat comprising:

a frame comprised of a lower frame section rotatably coupled to an upper frame section;

wherein the upper frame section is comprised of a pair of vertical supports;

an arm bar assembly comprising a first arm bar rotatably coupled to each one of the pair of vertical supports;

a chair seat secured to the frame;

wherein the lower frame section further comprises a pair of horizontal supports and a plurality of arm connectors attached to each horizontal support, wherein the arm connectors will engage the arm of an existing chair when the chair support and booster seat is attached to the existing chair.

2. The chair support adaptor and booster seat of claim 1, wherein the chair seat is removably secured to the frame.

3. The chair support adaptor and booster seat of claim 1, further comprising a seatbelt secured to the frame.

4. The chair support adaptor and booster seat of claim 1, further comprising a plurality of securement straps connected to the frame, wherein the securement straps will secure the frame to a chair.

5. The chair support adaptor and booster seat of claim 1, wherein the arm bar assembly further comprises a first arm bar rotatably coupled to the vertical support and a second arm bar coupled to the first arm bar.

6. The chair support adaptor and booster seat of claim 5, wherein the second arm bar is coupled to the first arm bar perpendicularly.

7. A chair support and booster seat and wheelchair assembly comprising:

a wheelchair comprising at least a plurality of wheels rotatably connected to a chair frame;

the chair frame is comprised of a seat frame, a seat back frame, and a plurality of arm supports;

a chair support and booster seat having a frame comprised of a lower frame section rotatably coupled to an upper frame section;

the upper frame section is comprised of a pair of vertical supports;

an arm bar assembly comprising a first arm bar rotatably coupled to each one of the pair of vertical supports;

a chair seat secured to the frame;

wherein the lower frame section further comprises a pair of horizontal supports and a plurality of arm connectors attached to each horizontal support, wherein each arm connector engages one of the plurality of support arms of the chair frame of the wheelchair.

8. The chair support and booster seat and wheelchair assembly of claim 7, wherein the chair seat is removably secured to the frame of the chair support and booster seat.

9. The chair support and booster seat and wheelchair assembly of claim 7, further comprising a seatbelt secured to the frame of the chair support and booster seat.

10. The chair support and booster seat and wheelchair assembly of claim 7, further comprising a plurality of securement straps connected to the frame, wherein the securement straps removably secure the frame of the chair support and booster seat to the chair frame of the wheelchair.

11. The chair support and booster seat and wheelchair assembly of claim 7, wherein the arm bar assembly further comprises a first arm bar rotatably coupled to the vertical support and a second arm bar coupled to the first arm bar.

12. The chair support and booster seat and wheelchair assembly of claim 11, wherein the second arm bar is coupled to the first arm bar perpendicularly.

* * * * *